US007226016B2

(12) United States Patent
Johnsson et al.

(10) Patent No.: US 7,226,016 B2
(45) Date of Patent: Jun. 5, 2007

(54) METHOD AND ARRANGEMENT FOR LOW OR NON-ROTATING ARTILLERY SHELLS

(75) Inventors: Stig Johnsson, Karlskoga (SE); Ulf Hellman, Karlskoga (SE); Ulf Holmqvist, Mörrum Karlskoga (SE)

(73) Assignee: BAE Systems Bofors AB (SE)

( * ) Notice: Subject to any disclaimer, the term of this patent is extended or adjusted under 35 U.S.C. 154(b) by 0 days.

(21) Appl. No.: 10/907,301

(22) Filed: Mar. 28, 2005

(65) Prior Publication Data

US 2007/0084961 A1 Apr. 19, 2007

Related U.S. Application Data

(63) Continuation of application No. 10/312,763, filed as application No. PCT/SE01/01331 on Jun. 13, 2001, now abandoned.

(30) Foreign Application Priority Data

Jul. 3, 2000 (SE) ..... 002479

(51) Int. Cl.
*F42B 10/14* (2006.01)

(52) U.S. Cl. ..... 244/3.28; 244/3.29; 102/473

(58) Field of Classification Search ..... 244/3.24, 244/3.26, 3.27, 3.28, 3.25, 3.23, 3.29; 102/473, 102/501

See application file for complete search history.

(56) References Cited

U.S. PATENT DOCUMENTS

| | | | | |
|---|---|---|---|---|
| 21,219 A | | 8/1858 | Sibley | |
| 2,426,239 A | | 8/1947 | Renner | |
| 2,821,924 A | | 2/1958 | Hansen et al. | |
| 3,622,103 A | | 11/1971 | Meier | |
| 4,332,360 A | | 6/1982 | Topliffe | |
| 4,545,940 A | * | 10/1985 | Mutoh et al. | 554/211 |
| 4,702,436 A | | 10/1987 | Arnell | |
| 4,884,766 A | | 12/1989 | Steinmetz et al. | |
| 4,899,661 A | | 2/1990 | Kaelin | |
| H905 H | | 4/1991 | Rottenberg | |
| 5,452,864 A | | 9/1995 | Alford et al. | |
| 5,892,217 A | | 4/1999 | Pollin | |
| 6,234,082 B1 | * | 5/2001 | Cros et al. | 102/520 |
| 6,454,205 B2 | | 9/2002 | Niemeyer et al. | |
| 6,571,715 B1 | | 6/2003 | Bennett et al. | |
| 7,004,425 B2 | * | 2/2006 | Okada et al. | 244/3.29 |

FOREIGN PATENT DOCUMENTS

| | | |
|---|---|---|
| EP | 0076990 A2 | 4/1983 |
| GB | 2265443 A | 9/1993 |
| SE | 444 612 | 4/1986 |
| WO | WO98/43037 | 10/1998 |

* cited by examiner

*Primary Examiner*—Tien Dinh
(74) *Attorney, Agent, or Firm*—Connolly Bove Lodge & Hutz, LLP; Larry J. Hume

(57) ABSTRACT

This disclosure relates to a method and an arrangement for low or non-rotating artillery shells fired from launch weaponry, and which introduces a portion of the barrel pressure built up in the barrel during the launch phase into a chamber arranged in the low or non-rotating artillery shell which is delimited in at least one direction by an element which is movable relative to the rest of the shell when a differential pressure between the chamber and the external environment of the shell is sufficient to move the element. The moveable element may be a protective casing covering fins of the artillery shell.

11 Claims, 7 Drawing Sheets

METHOD AND ARRANGEMENT FOR LOW OR NON-ROTATING ARTILLERY SHELLS

CROSS REFERENCE TO RELATED APPLICATIONS

This application is a continuation of co-pending application Ser. No. 10/312,763 filed on Jul. 1, 2003. application Ser. No. 10/312,763 is a National Stage Entry of International Application PCT/SE01/01331, filed on Jun. 13, 2001. International Application PCT/SE01/01331 claims priority to Swedish application serial number 00024794.4, filed on Jul. 3, 2000. The entire contents of each of these applications are incorporated herein by reference.

BACKGROUND

The present disclosure relates to a method and an arrangement for producing a relative displacement of specific elements included in artillery missiles, this relative displacement being intended to be activated as soon as the missile has left the barrel from which it has been fired.

The disclosure is in the first instance intended to be used in those artillery missiles which are fired without rotation or at a low inherent rotation about their longitudinal axis (e.g., by use of a so-called "skidding drive band"), and which, for stabilizing them in the continued trajectory towards the target, are assumed to be provided with stabilizing fins which are arranged at the rear end and are initially retracted until the missile has completely exited the launch arrangement from which it has been fired, and then are deployed once it has left the launch arrangement. To guide the missiles in their trajectories in pitch and yaw towards their intended targets, they can also be provided with guide members arranged for this purpose preferably at their front end and deployable more or less simultaneously.

Airborne missiles can be rotation-stabilized in their trajectory or stabilized in another way, for example by means of fins. Rotation-stabilized missiles have steady trajectories and they can be made mechanically simple since the launch arrangement as a rule is responsible for ensuring that the missile acquires the necessary initial rotation. However, the high rotational velocity has at least hitherto made it impossible to provide this type of missile with a well-functioning guidance system. When work is undertaken today to develop effective guidable missiles, one has therefore concentrated efforts on missiles which do not rotate at all, or rotate only slowly, about their own longitudinal axis and which are aerodynamically stabilized by means of fins arranged in their rear part.

In addition to stabilizing the missile flight, the stabilizing fins, in a fin-stabilized non-rotating missile, or in a missile rotating only slowly, can additionally, if they are arranged for this purpose, give rise to an active lifting force which acts on the missile and can be used to increase its range of fire.

A current trend in the development of artillery technology is towards new long-range artillery missiles guided in their final phase, and interest has increased in different types of fin-stabilized shells intended for firing in conventional guns and howitzers. To make it possible to launch fin-stabilized shells with a low inherent rotation directly from grooved barrels, the shells need to be provided with a drive band (conventionally known as a "skidding drive band") as their only direct contact with the grooving of the barrel. The same gun or howitzer can thus be used, without special intermediate measures, to successively fire essentially non-rotating shells provided with drive bands and with stabilizing fins, which can be deployed in trajectory, and entirely conventional rotation-stabilized shells.

In controlling the trajectory of fin-stabilized missiles such as shells, rockets and projectiles, it is necessary to know and be able to control the roll position of the missile. This is necessary in order to be able to control the missile in pitch and yaw. This control is achieved preferably with special control elements, for example in the form of movable nose fins, so-called canard fins, or jet nozzles. The roll control moment which such control members in the front part of the missile give rise to can however in many cases be counteracted or completely eliminated by the guide fins in the rear part of the missile, unless special measures are taken. This is due to the fact that the vortices caused by the control moment from the rudder or other control activity impact the fins and this in turn gives rise to a counteracting moment.

BRIEF SUMMARY

A way of solving this problem which has already been tested to an at least limited extent is to let the part of the missile in which the fins are secured constitute a unit which can rotate freely in relation to the rest of the missile about an axis concentric with the longitudinal axis of the missile. In this way, the effect of the control moment on the fins cannot be transferred to the front part of the missile, as a result of which the missile is made easier to control.

However, the design and function of the fins are of secondary importance in connection with the present disclosure to the extent that it does not concern the fins as such, although an embodiment of this offers a method and arrangement for protecting the fins and keeping them retracted during the launch phase and releasing them as soon as the missile in question has left the barrel of the gun or howitzer from which it is fired.

The disclosure can thus be applied both to those fin units which during the launch phase are protected by a special protective casing which has to be removed in order to release the fins, and in those fin units which during the launch phase are protected inside the missile and which, immediately after the latter has left the barrel, are pushed out behind the original rear plane of the missile.

The basic concept of embodiments of the disclosure is that it is possible during the actual launch phase, that is to say while the missile is being driven through the barrel of the gun, howitzer or the like from which it is being fired, to introduce some of the powder gases driving the missile from the space behind the missile into a partially closed chamber in the missile, this chamber being delimited in at least one direction by the object, element or the like which is displaceable relative to the rest of the missile and which is to be displaced after the missile has left the barrel, while the inlet through which the powder gases are introduced into the chamber in question is so dimensioned that the high powder gas pressure inside the chamber is not able to equalize as quickly as the pressure behind the missile is equalized in relation to the surrounding atmosphere as soon as the missile has left the barrel. If correctly dimensioned, the pressure inside the chamber then gives rise to the desired relative displacement as the powder gas pressure inside the chamber acts on the displaceable object which, when the missile has left the barrel, is no longer acted upon in the opposite direction by the rear barrel pressure.

This basic idea can then be used to release and push aside a protective casing which during the launch phase covers the rear part of the missile and a fin unit included therein or in a corresponding manner to push out a fin unit which during the launch phase has been retracted in the rear part of the missile, or to force out radially displaceable fins, or for other areas of application which fall within the scope of this basic idea.

The general concept of the disclosure is defined in the attached patent claims and it will now be described in more detail in connection with three different examples of how the disclosure can be used.

Of these, the first describes a method of removing a protective casing which initially covers the rear part of a missile and which during the launch phase protects an axially fixed fin unit comprising blade fins incurved towards that part of the missile body situated inside the casing. In this variant, the barrel pressure is introduced during the launch phase into the casing via an opening provided and dimensioned for this purpose. As soon as the pressure behind the casing drops, that is to say as soon as the shell has left the barrel, the pressure inside the same forces the casing off from the missile body, whereupon the hitherto incurved fins are deployed.

In the second use of the disclosure described below, the same internal barrel pressure is used to push rearwards in the direction of flight of the shell, an axially movable fin unit out from a first position retracted in the missile to a second position in which the fins, which can also be deployable, reach behind the original rear plane of the missile. In this variant of the disclosure, some of the barrel pressure during the launch phase is introduced into an inner chamber situated between the axially displaceable fin unit and the main part of the missile, and when the counter-pressure behind the missile which also loads the fin unit ceases when the missile leaves the barrel, this internal pressure forces the axially movable fin unit out to its rear position in the longitudinal direction of the missile.

The third example describes how the same barrel pressure is used to release a protective casing of approximately the same type as in the first example and additionally at the same time to force radially movable fins out from a first retracted position to a second deployed position.

However, all these examples must be seen for what they are, namely a few possible variants of practical applications of the disclosure, which itself can be given other applications falling within the scope of the patent claims.

DETAILED DESCRIPTION

Figure 1:
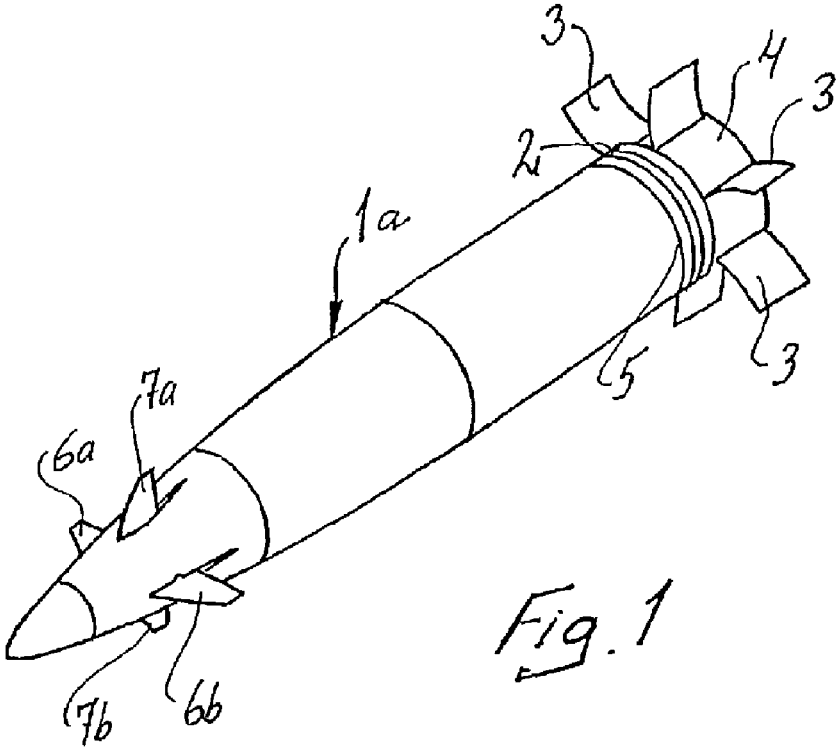
FIG. 1 shows a low inherent rotation or non-rotating shell according to the abovementioned first variant, on its way towards its target.

The missile shown in FIG. 1, in this case the shell 1*a*, is provided with a band track 2 for a drive band which is conventionally known as a "skidding drive band", which is generally lost when the shell leaves the barrel in order to effect low inherent rotation or no rotation of the shell. A number of deployable fins 3 are shown fully deployed in the figure and which are fixed on a body part 4 which rotates freely relative to the rest of the shell about an axis concentric with the longitudinal axis of the shell. The dividing plane between the shell 1 and the body part 4 has been labeled 5. In addition, the shell 1 has two pairs of controllable canard fins 6*a*, 6*b* and 7*a*, 7*b* arranged on a respective quadrant axis and with which the course and trajectory of the shell can be corrected in accordance with control commands received either from an internal target seeker or from the launch site, via satellite, radar or other means. The way in which the shell receives control commands has nothing to do with the disclosure. This question will not therefore be mentioned again below.

Figure 2:
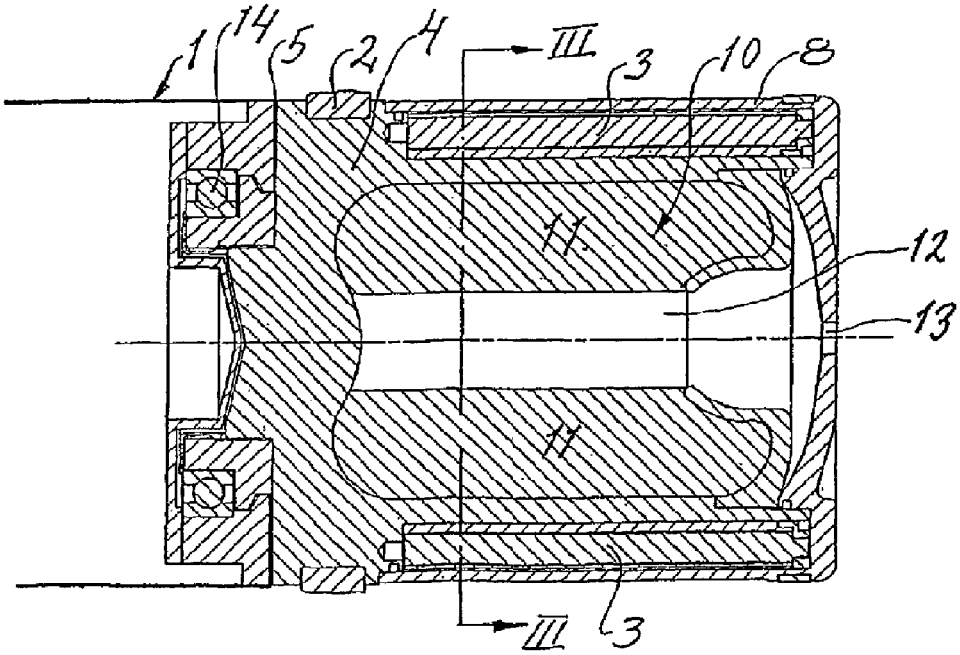
FIG. 2 shows in longitudinal section the rear part of the same shell as in FIG. 1, before being launched.
Figure 3:
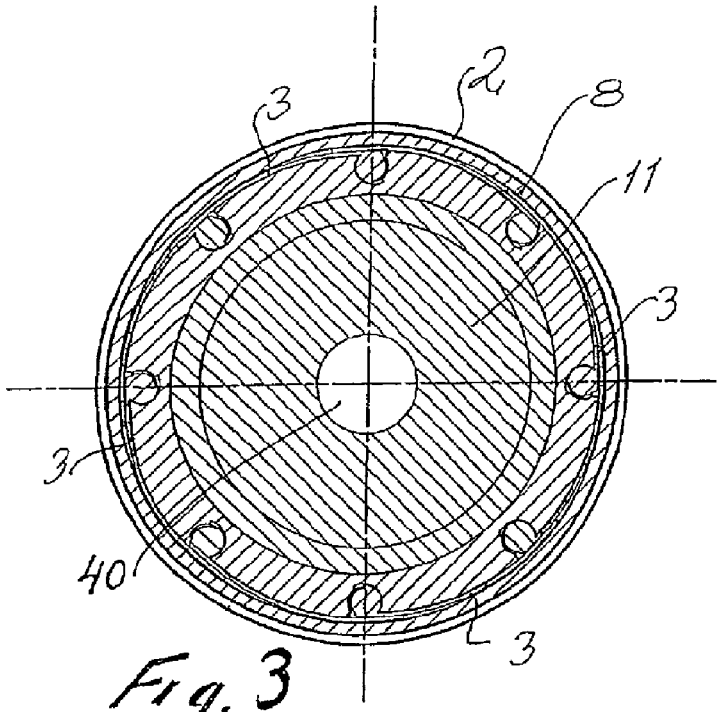
FIG. 3 shows the cross section along III-III in FIG. 2.
Figure 4:
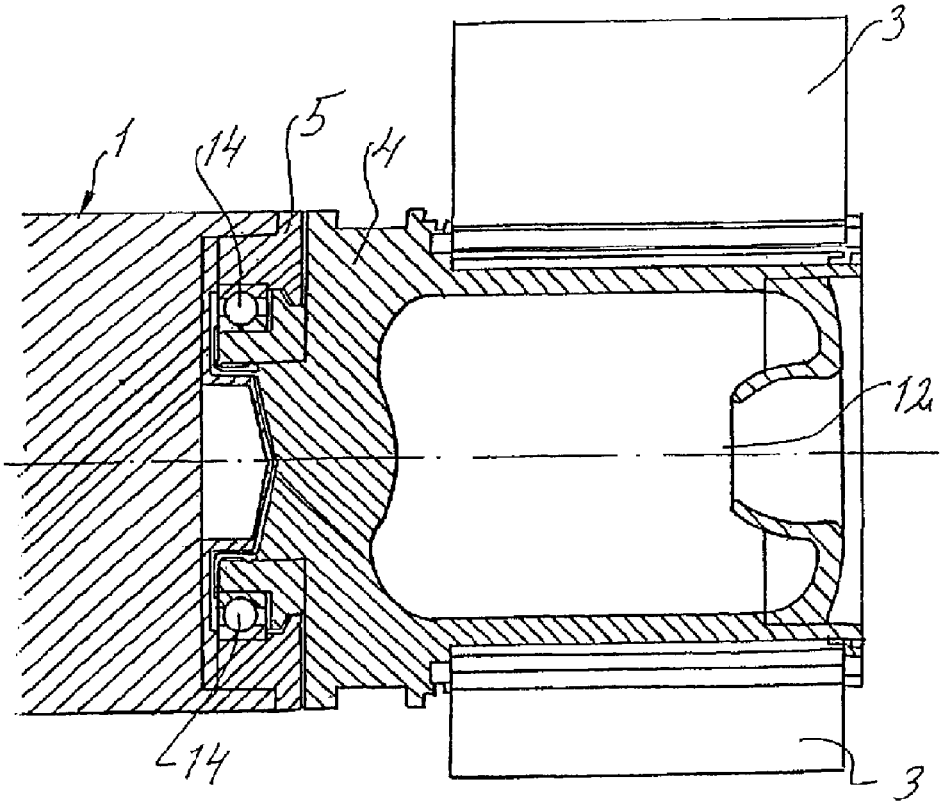
FIG. 4 shows the same details as in FIG. 2, but after launch, and with the fins deployed.

FIGS. 2, 3, and 4 show in greater detail how the body part 4 is constructed. Also included here are reference labels 2 for the band and 5 for the dividing plane between the body part and the rest of the shell. As will be seen from the figures, the band of the shell in this variant is placed on the body part 4 of the fin unit. This is because it is advantageous to have the band placed far back on a shell. The fins 3 are shown in FIGS. 2 and 3 in the retracted position (see also FIGS. 1 and 4) in which they are covered by a removable casing 8. In the case shown in FIGS. 2 and 3, the casing covers the fins and also a base-bleed unit 10 which is arranged in the centre of the body part and whose charge of slow-burning powder here has the label 111 and its gas outlet has the label 12.

As will be seen from FIG. 3, the fins 3 in the retracted position are incurved towards the inside of the casing 8. In the casing 8 there is also a relatively narrow gas inlet 13 which upon launch of the shells gives the barrel pressure, i.e. the powder gases from the propellant powder charge, free access to that part of the inside 40 of the base-bleed unit which is not taken up by its powder charge 11. At the same time the inlet and outlet 13 in the casing 8 is so designed that when the shell leaves the barrel and the pressure surrounding the shell quickly drops to atmospheric pressure, the gas expansion reaches inside the casing by means of the fact that the inlet and outlet 13 is so designed that the gases do not get out quickly enough, resulting in the casing being removed and the fins being released and deployed. This position is shown in FIG. 4.

As will further be seen from the figures, the body part 4 is joined to the rest of the shell via a ball bearing 14 which means that the fin unit can rotate freely after the fins have been deployed. This does not in itself have anything to do with the present disclosure even though, as mentioned in the introduction, it does have some important advantages.

Figure 5:
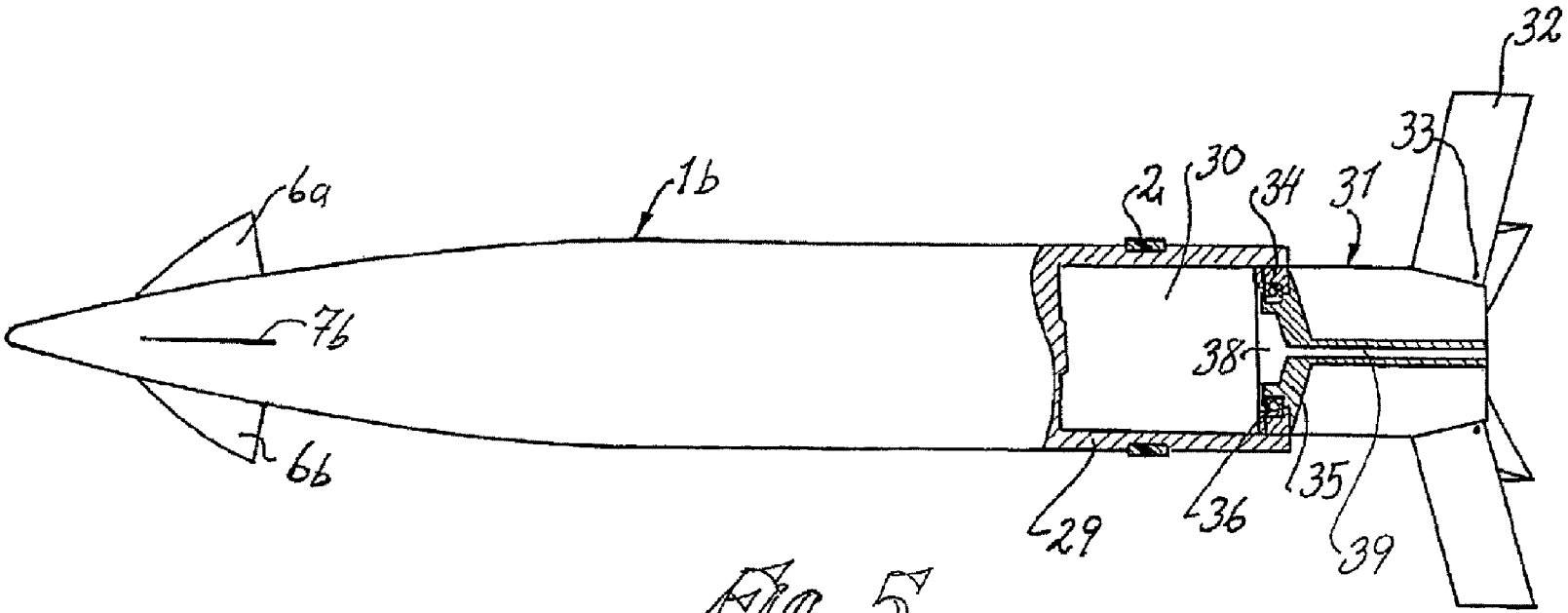
FIG. 5 shows a partial cross section of a missile according to the abovementioned alternative two, i.e., with a fin unit which is displaceable in the longitudinal direction.
Figure 6:
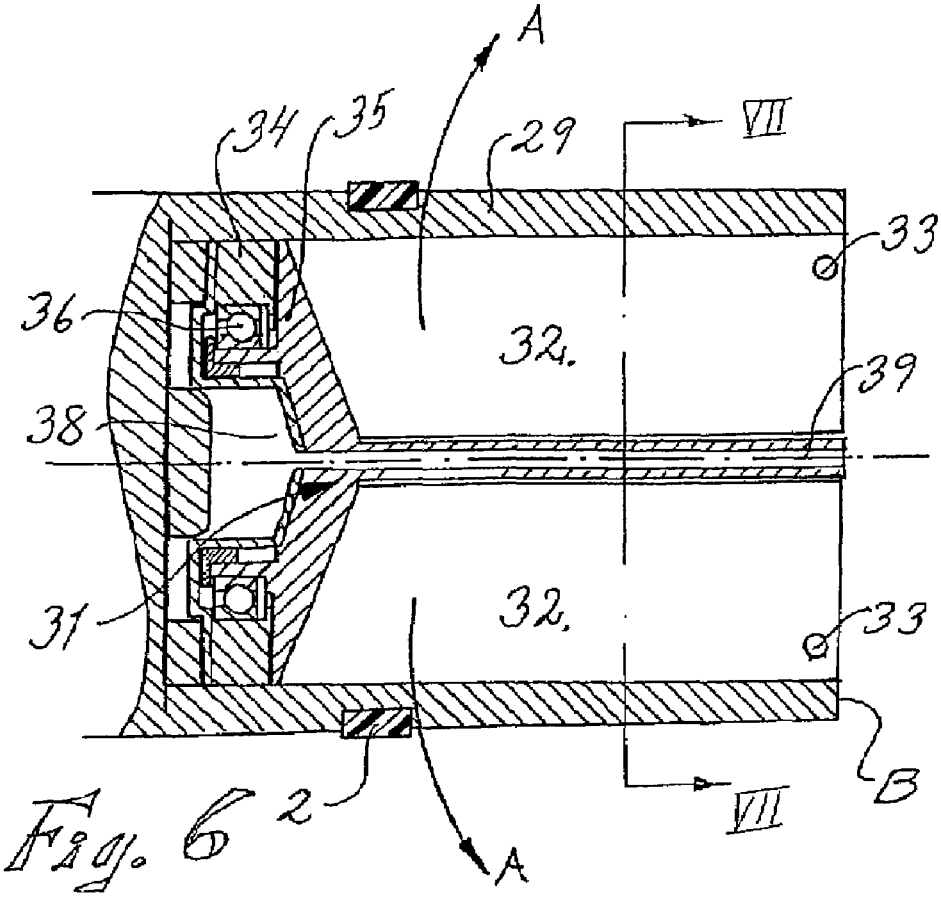
FIG. 6 shows the fin unit according to FIG. 5 in the retracted position.
Figure 7:
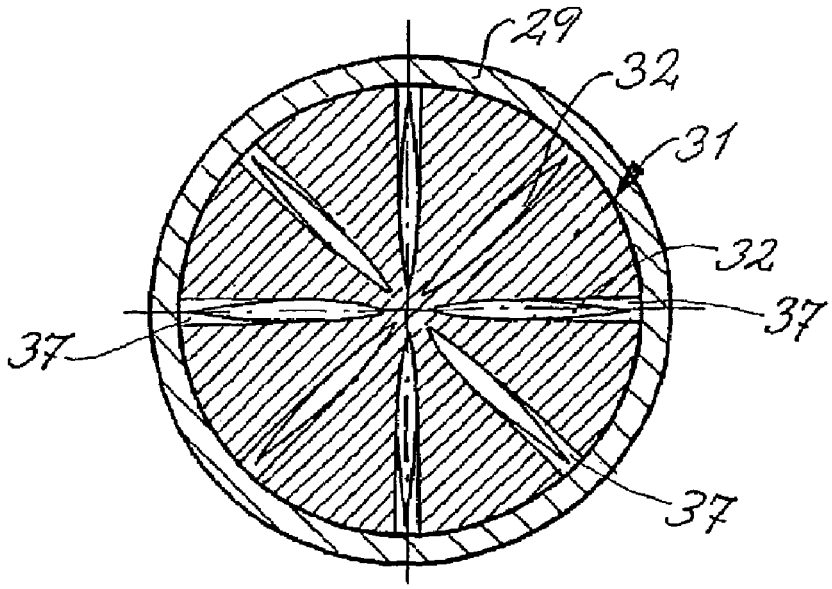
FIG. 7 shows the cross section VII-VII from FIG. 6.

The shell illustrated in FIGS. 5, 6 and 7 is thus of the second type described in more general terms earlier, with a fin unit which is axially displaceable in the longitudinal axis of the shell. Its main part has been labeled 1*b* and it is provided in its rear part, here labeled 29, with a drive band 2. A cavity 30 is also arranged in the rear part 29 of the shell. A specially configured fin body 33 is arranged inside this cavity until the shell has left the artillery piece in which it is fired.

The fin body with its retracted fins is shown in the retracted position in FIGS. 6 and 7. There are eight fins here and they are all labeled 32. Each one of them lies in its own track 37 in the body part 31 and they can be deployed outwards and rearwards about their axes 33, in the manner indicated by the arrows A in FIG. 7. The special fin body 31 consists of a front part 34 and a rear part 35 which are rotatable relative to each other with a ball bearing 36 which means that this fin unit too spins freely in the deployed position.

The special feature of the variant of the disclosure described here is that when the shell has left the artillery piece from which it is fired the whole of the fin body 31 is displaced from its fully retracted position in the space 30 to a position where only its front part 34 is left in its outlet, where it is blocked by means of a deformation joint of one type or another, while the whole of the rear part 35 of the fin body is located behind the original rear plane B of the shell and where the fins 32 are deployed in the manner indicated in FIG. 6 and the rear part of the body in which they are secured is allowed to rotate freely relative to the main part of the shell about the bearing 36 concentric with the longitudinal axis of the shell.

For moving the body part 31 to its rear position, propellant powder gases are used which during the launch phase are allowed to flow via the channel 39 into the inner chamber which is labeled 38. When the shell leaves the barrel from which it has been fired, the pressure behind the fin unit quickly drops to atmospheric pressure, while the pressure inside the chamber 38 becomes higher. As the counter-pressure behind the fin unit drops, the gas quantity at a higher pressure inside the chamber 38 will expand. This gives the desired displacement of the fin unit to its outer position shown in FIG. 5. However, the original pressure inside the chamber 38 should never be allowed to rise to the same level as the barrel pressure since this would result in excessively rapid fin deployment with associated risks of damage to the fin unit.

The maximum pressure inside the chamber 38 is entirely dependent on what quantities of propellant gas leak into the chamber through the channel 39 as the missile passes through the barrel. The maximum pressure inside the chamber can thus be regulated by precise dimensioning of this channel.

A particular advantage of the push-out fin unit is that its fins reach further away from the centre of gravity of the missile than when the fins are secured directly at the rear end of the missile. This in turn means that the fins of the push-out fin unit can be made smaller while retaining the stability of the missile.

Figure 8:
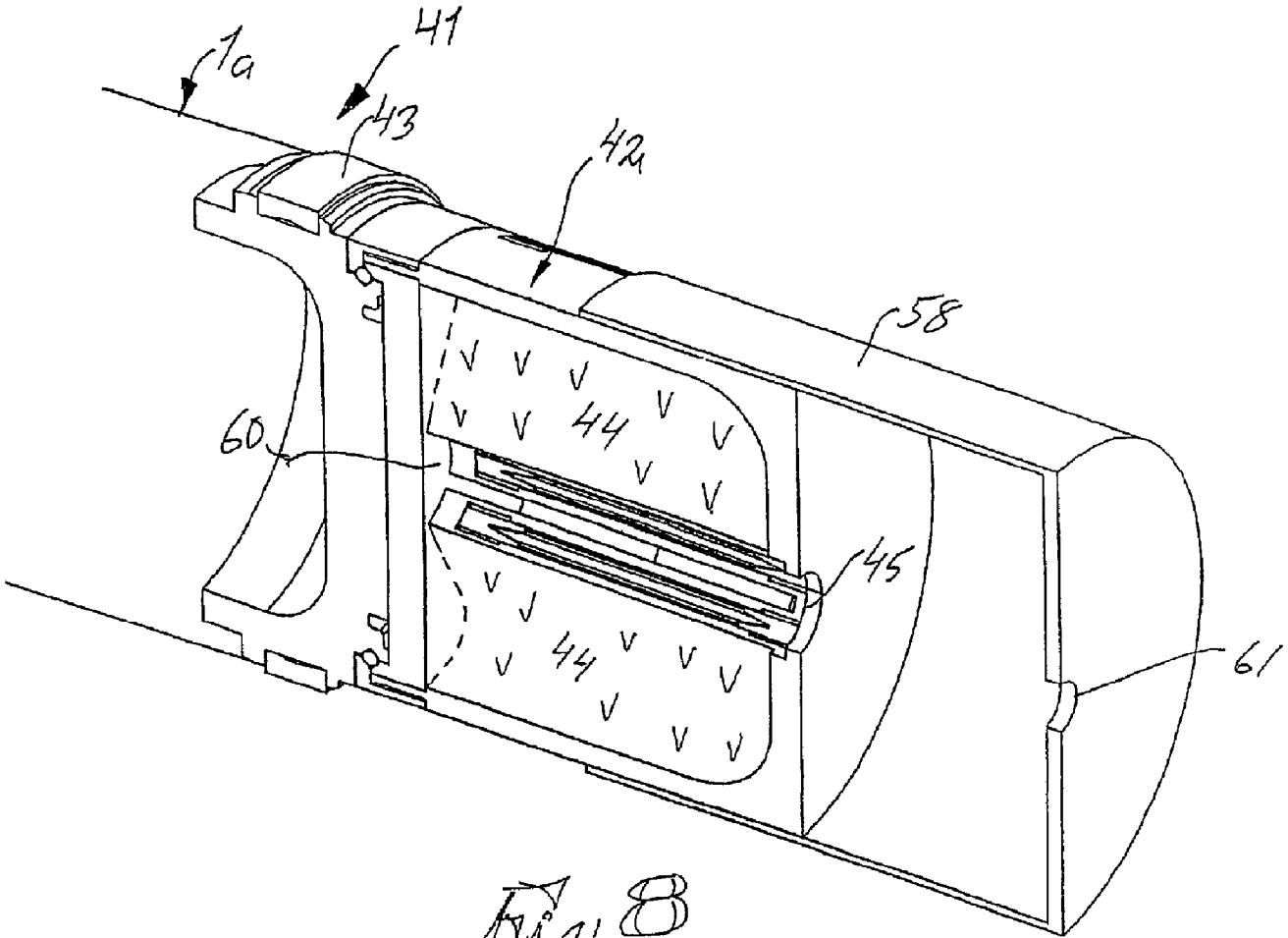
FIG. 8 shows a sectional view of the rear part of a shell according to the abovementioned alternative three.
Figure 9:
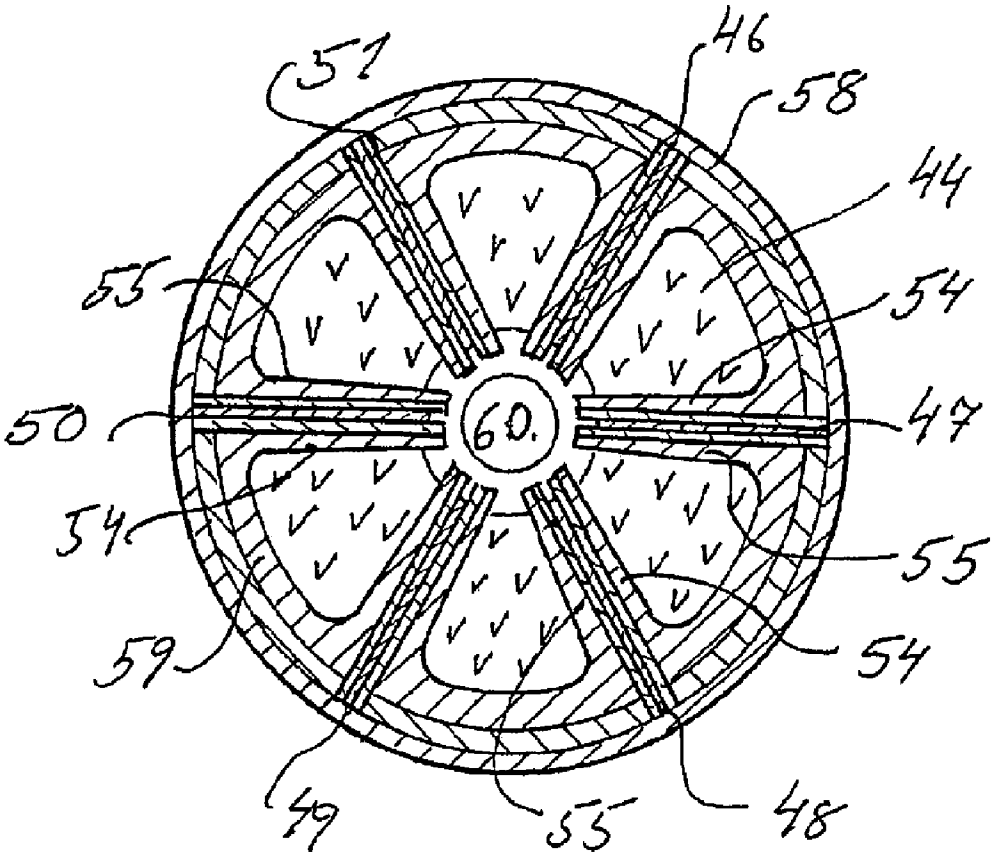
FIG. 9 shows a cross section along the line IX-IX in FIG. 8.
Figure 10:
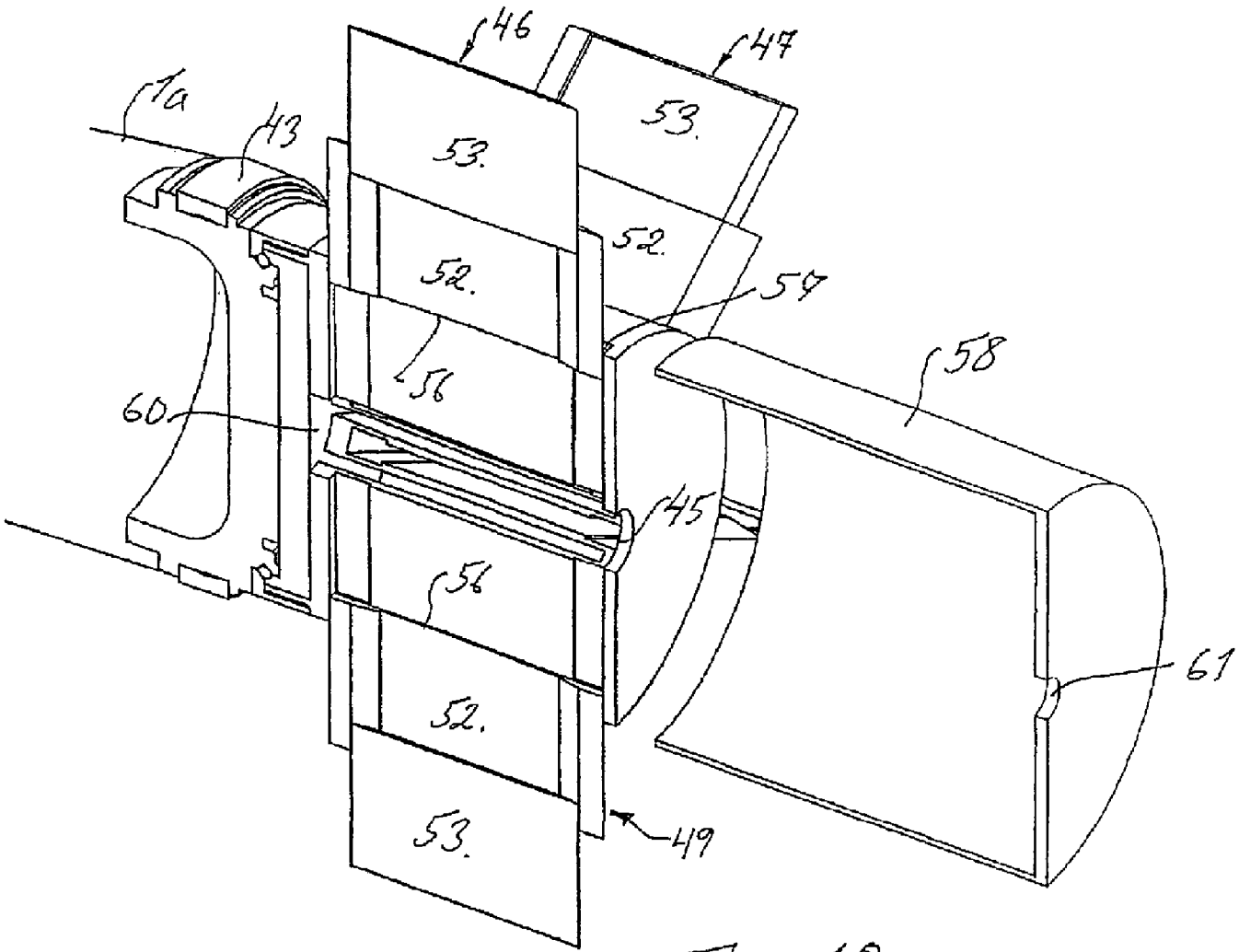
FIG. 10 shows the same view as in FIG. 8, but after the fins have been deployed.

FIGS. 8 to 10 show the rear part of a shell which otherwise can correspond to the shell 1*a* in FIG. 1. In this variant, the rear part 41 of the shell 1*a* has a base-bleed unit which is generally labeled 42. Immediately in front of the base-bleed unit 42 there is a track in the shell body in which the plastic drive band 43 of the shell 1*a* is mounted. The base-bleed unit 42 comprises a number of powder chambers 44 which in cross section have a circular sector shape (see FIG. 9) and each initially includes a slow-burning powder and a central gas outlet 45.

FIGS. 8 and 10 show the position after the shell 1*a* (which is not shown in its entirety in the figures) has just left the barrel of the artillery piece. A number of deployable fins 46-51 are also arranged in said rear part 41 of the shell. These fins are shown in the retracted position in FIGS. 8 and 9 and in the deployed position in FIG. 10. Each of the fins consists of an inner primary fin 52, which can be retracted into the shell body or more precisely into the base-bleed unit 42, and a secondary fin 53 which can be telescoped into the primary one. Each of the primary fins 52 is radially controlled and radially displaceable between supporting and protecting walls 54 and 55, respectively, arranged on either side of it (see FIG. 9), and since the inner longitudinal edges 56 of the primary fins 52 additionally have free contact with the inside of the powder chamber 44, the primary fins 52 start to move, as soon as they are allowed to, after the shell has left the barrel and the casing 58 has been removed, forced out by the remaining barrel pressure through respective slits 57 in the shell body by the remaining pressure from the barrel phase, possibly supplemented by the pressure from the ignited base-bleed powder.

The secondary fins 53 are correspondingly mounted and are displaceable in the primary fins 52 and thus are also dependent on the powder gas pressure in the powder chamber 44 for their deployment. Until the moment when the shell 1*a* has left the barrel of the artillery piece in connection with the launch phase, allowing for a slight margin, both the base-bleed unit 42 and the retracted fins are covered by a protective casing 58. FIG. 8 shows a position in which the protective casing 58 has begun to be pushed away from its original position. In the original position, the protective casing 58 covers the whole of the base-bleed unit 42. The pushing-off of the casing and the deployment of the fins are activated in the previously described manner by that part of the propellant gas pressure which has been allowed during the launch phase to leak into the inside of the casing and the base-bleed unit 42 via the opening 61.

At the same time as or immediately after the protective casing 58 is removed, the powder charge of the base-bleed unit is initiated, and at the same time the remaining pressure from the barrel phase is used to force out the fin parts. When the primary fins 52 reach their respective outer positions, their respective inner longitudinal edges 56 seal the gap in the base-bleed unit wall through which they are deployed and at the same time the gas pressure also forces out the secondary fins 53 to a correspondingly sealed and blocked outer position.

As can be seen principally from FIG. 9, the inner primary fins 52 in the retracted position are surrounded on each side by the previously mentioned protective walls 54, 55 which form part of a temperature-resistant lining 59 of the powder chamber 44 of the base-bleed unit and which thus in pairs of two adjoining fins divide up the powder chamber into a number of sectors or fissures which each originally contain a suitable quantity of powder or powder body. Also arranged at the centre of the unit there is a central powder gas and ignition channel 60 which is common to all the powder chamber sectors to the extent that these open into the latter. As has already been mentioned, the inlet of the casing 58 has been labeled 61.

Since each of the powder sectors has in this way been able to be given a limited size and a good lateral support between the protective walls 54, 55 of the adjoining primary fins 52, it has been possible to eliminate the risks of the powder charge in the base-bleed unit being damaged during actual firing, that is to say before it is brought into operation, and at the same time the division gives the powder bodies a high level of strength right up to the time they burn out.

What is claimed as new and desired to be protected by Letters Patent of the United States is:

1. A method of launching a low or non-rotating fin-stabilized artillery shell from a launch weapon, the method comprising:

generating propellant powder gases in a barrel of the launch weapon during a launch phase of the low or non-rotating fin-stabilized artillery shell;

introducing at least a portion of the propellant powder gases from the barrel into a chamber of the artillery shell during the launch phase, wherein the chamber is arranged at a rear end of the shell to be in communication with a casing which is movable relative to a front portion of the low or non-rotating fin-stabilized artillery shell and which covers at least part of the rear part of the shell situated behind a drive band of the non-rotating fin-stabilized artillery shell;

applying a barrel pressure to an external rear portion of the casing so as to maintain a relative position of the casing with respect to the front portion of the low or non-rotating fin-stabilized artillery shell when the low or non-rotating fin-stabilized artillery shell is located inside the barrel during the launch phase;

after the low or non-rotating fin-stabilized artillery shell is located outside the barrel of the launch weapon after the launch phase, establishing a differential pressure with respect to an external atmosphere via an outlet in the casing to establish a differential pressure;

after the non-rotating fin-stabilized artillery shell has been launched from the launch weapon, removing the casing from the shell by using the differential pressure;

deploying fins of the low or non-rotating fin-stabilized artillery shell in response to the removal of the casing; and enabling free rotation of the fins with respect to the front portion of the low or non-rotating fin-stabilized artillery shell about a longitudinal axis of the artillery shell by using a ball bearing assembly arranged around the longitudinal axis.

2. The method of claim 1, wherein the at least a portion of the propellant powder gases are introduced at high pressure in said chamber via an inlet dimensioned in such a way that, when a counter-pressure drops to a normal atmospheric pressure outside the barrel, the propellant powder gases introduced at high pressure into said chamber are not equalized at the same rate, but instead provide a relative displacement of the casing in a rearward direction with respect to the front portion of the non-rotating fin-stabilized artillery shell.

3. The method of claim 1, wherein a pressure from the propellant powder gases is accumulated in the chamber via an inlet which is dimensioned in such a way that, when a counter-pressure external to the chamber drops to a normal atmospheric pressure outside the barrel, the propellant powder gases in the chamber are at a higher pressure than the normal atmospheric pressure, wherein the higher pressure give rise to the displacement of the casing in a rearward direction with respect to the front portion of the non-rotating fin-stabilized artillery shell.

4. The method of claim 1, wherein said deploying fins of the non-rotating fin-stabilized artillery shell comprises, after the casing is removed, deploying a plurality of fins which are arranged in a rear part of the non-rotating fin-stabilized shell and which, from a retracted position, are forced out transverse to a direction of flight of the non-rotating fin-stabilized shell, wherein, during the launch phase, the plurality of fins are kept retracted by the casing covering the rear part of the non-rotating fin-stabilized shell, wherein the casing is removed by the portion of the propellant powder gases accumulated in the chamber and, after the casing has been removed, a remaining gas pressure from the chamber is used to force out the fins.

5. The method of claim 1, further comprising, after the non-rotating fin-stabilized shell has been launched from the launch weapon, pushing a fin unit, initially located inside the non-rotating fin-stabilized shell, rearwards relative to a direction of flight of the non-rotating fin-stabilized shell behind a rear plane of the non-rotating fin-stabilized shell, wherein the fin unit is pushed rearward by the portion of the propellant powder gases accumulated in the chamber.

6. A low or non-rotating fin-stabilized artillery shell which is suitable for use in conjunction with the method of launching a non-rotating fin-stabilized artillery shell of claim 1, the non-rotating fin-stabilized shell comprising:

a chamber arranged inside the non-rotating fin-stabilized shell and which is delimited in at least one direction by the casing which, in an original position during a launch phase of the non-rotating fin-stabilized shell from a barrel, is externally acted upon by a propellant powder pressure in the barrel;

an inlet which leads to said chamber from a part of the non-rotating fin-stabilized shell which, when viewed in a direction of flight, is situated behind a skidding drive band, wherein some of the barrel pressure during the launch phase gains access to the chamber through the inlet; and a plurality of fins arranged in a rear portion of the non-rotating fin-stabilized artillery shell;

wherein the ball bearing assembly enables free rotation of the plurality of fins with respect to a front portion of the non-rotating fin-stabilized artillery shell about a longitudinal axis of the non-rotating fin-stabilized artillery shell.

7. The low or non-rotating fin-stabilized artillery shell arrangement of claim 6, wherein the inlet is dimensioned such that the pressure which builds up inside the chamber during the launch phase of the shell acts upon the casing after the non-rotating fin-stabilized shell has been launched from the launch weapon.

8. The low or non-rotating fin-stabilized artillery shell arrangement of claim 6, wherein the plurality of fins are initially arranged in a rear part of the non-rotating fin-stabilized shell first in a retracted position, and then in a position which is transverse to a direction of flight of the non-rotating fin-stabilized shell after the non-rotating fin-stabilized artillery shell exits the barrel, wherein, during the launch phase, the plurality of fins are kept retracted by the casing.

9. The low or non-rotating fin-stabilized artillery shell arrangement of claim 6, wherein the plurality of fins are arranged in a fin unit which is initially located inside the non-rotating fin-stabilized shell, and which is moved rearwards relative to a direction of flight of the non-rotating fin-stabilized shell behind a rear plane of the non-rotating fin-stabilized shell after the non-rotating fin-stabilized artillery shell exits the barrel.

10. The method of claim 1, wherein said deploying fins comprises pivoting the fins around respective axes arranged along a longitudinal axis of the artillery shell.

11. A low or non-rotating fin-stabilized artillery shell, the fin-stabilized shell comprising:

a chamber arranged inside the non-rotating fin-stabilized shell;

a casing arranged in an original position during a pre-launch phase so as to cover a plurality of folding fins, wherein an exterior portion of the casing is further adapted so as to be externally acted upon by a barrel pressure during a launch phase;

an inlet allowing communication between said chamber and said exterior portion of the casing and through which the chamber is pressurized by a barrel pressure during the launch phase, wherein, after the artillery shell has exited the barrel, and in response to a differential pressure between the chamber and the exterior portion of the casing, the casing is removed so as to enable unfolding of the plurality of folding fins; and a ball bearing assembly arranged to enable free rotation of the plurality of folding fins about a longitudinal axis of the artillery shell with respect to a front portion of the artillery shell.

* * * * *